US006276314B1

(12) United States Patent
Yapici

(10) Patent No.: US 6,276,314 B1
(45) Date of Patent: Aug. 21, 2001

(54) DRIVE FOR POSITIONING A SETTING DEVICE

(75) Inventor: Kurt Imren Yapici, Eschweiler (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 09/655,884

(22) Filed: Sep. 6, 2000

Related U.S. Application Data

(63) Continuation of application No. 09/556,307, filed on Apr. 24, 2000.

(30) Foreign Application Priority Data

Apr. 23, 1999 (DE) ..... 199 18 592

(51) Int. Cl.[7] ..... F02B 75/32
(52) U.S. Cl. ..... 123/78 F
(58) Field of Search ..... 123/78 F, 48 B, 123/197.4, 197.3

(56) References Cited

U.S. PATENT DOCUMENTS

| | | | | |
|---|---|---|---|---|
| 4,152,955 | * | 5/1979 | McWhorter | 123/78 F |
| 4,485,768 | * | 12/1984 | Heniges | 123/48 B |
| 4,535,730 | * | 8/1985 | Allen | 123/78 F |
| 5,680,840 | * | 10/1997 | Mandella | 123/78 F |
| 5,732,673 | * | 3/1998 | Mandella | 123/197.4 |

* cited by examiner

*Primary Examiner*—Marguerite McMahon
(74) *Attorney, Agent, or Firm*—Venable; Gabor J. Kelemen

(57) ABSTRACT

A setting assembly in a piston-type internal-combustion engine includes a setting device connected to a component for adjusting its position; a power device; and a gearing having an input member connected to the power device for driving the gearing by the power device, an output member connected to the setting device for driving the setting device by the gearing; a down-stepping arrangement forming part of the gearing for providing a substantially down-stepped transmission ratio between the input and output members; and a reversing arrangement for reversing the direction of motion of the output member.

8 Claims, 5 Drawing Sheets

DRIVE FOR POSITIONING A SETTING DEVICE

CROSS REFERENCE TO RELATED APPLICATION

This application is a continuation of co-pending Application No. 09/556,307 filed Apr. 24, 2000.

This application claims the priority of German Application No. 199 18 592.1 filed Apr. 23, 1999, which is incorporated herein by reference.

BACKGROUND OF THE INVENTION

This invention relates to a drive for positioning a setting (adjusting) device in a piston-type internal-combustion engine.

In certain modes of application it may be a requirement, for example, to shift the position of a first shaft in such a manner that the shaft axis is displaced perpendicularly to itself with respect to a fixed reference plane while the rotary axis of a second shaft which extends parallel to the first shaft, preserves its defined position relative to the reference plane. Such a requirement is encountered, for example, in an internal-combustion engine in which a change of volume of the combustion chamber has to be effected by shifting the crankshaft axis toward or away from a reference plane. For such a change of position of the crankshaft significant setting and holding forces are necessary which may be applied only with difficulty by conventional electric actuators which, in an internal-combustion engine of a vehicle, have to be supplied with electric energy from an onboard power source.

Shifting devices of the above-outlined type may also be required for adjusting the cam shaft in an internal-combustion engine.

SUMMARY OF THE INVENTION

It is an object of the invention to provide an improved drive of the above-outlined type which may apply large setting and holding forces with little energy input for positioning a setting device of an internal-combustion engine.

This object and others to become apparent as the specification progresses, are accomplished by the invention, according to which, briefly stated, a setting assembly in a piston-type internal-combustion engine includes a setting device connected to a component for adjusting the position of the component; a power device; and a gearing having an input member connected to the power device for driving the gearing by the power device, an output member connected to the setting device for driving the setting device by the gearing; a down-stepping arrangement forming part of the gearing for providing a substantially down-stepped transmission ratio between the input and output members of the gearing; and a reversing arrangement for reversing the direction of motion of the output member.

By using a highly down-stepped gearing, large setting forces may be applied with a small driving force. According to a further advantageous feature of the invention, the gearing may be selectively immobilized (locked) or released in any given setting position by a switchable locking arrangement which requires only small holding forces.

In accordance with another advantageous feature of the invention, the gearing is self-locking. This may be accomplished by a gearing which is a worm-and-gear drive and in which the worm is on the driving side.

The back-and-forth motion required for the positioning of the setting device between two end positions is effected expediently by a rotary drive. In case of an electric rotary drive the back-and-forth motion may be produced electrically by a reversal of the rotary direction. It is, however, particularly expedient if the drive means is constituted by the internal-combustion engine itself, in which case the engine is connected with the gearing of the setting device by a switchable clutch. According to the invention in such a drive arrangement the means for reversing the rotary direction is formed by a switchable reversing gear unit of the gearing. The driving force may be taken from the crankshaft of the internal-combustion engine via a drive belt, preferably the toothed belt for actuating the cam shaft or from the belt which drives the alternator. Since the drive operates with a constant rotary direction, the required back-and-forth motion for the setting device may be effected by a switchable reversing gear unit of the gearing.

According to an advantageous feature of the invention, the switchable clutch is constituted by an electromagnetic clutch which operates without mechanical contacting. Such an electromagnetic clutch has the advantage that the setting process may be performed smoothly. Thus, particularly in case of small setting displacements, the setting process may be performed slowly and continuously or in a timed manner dependent on the actuation of the clutch. The electric energy required for actuating the electromagnetic clutch is significantly less than in case of a direct drive from an own setting motor.

As a particularly advantageous mode of application, the invention provides that the setting device is utilized for shifting the engine crankshaft to change the volume of the combustion chamber in the engine cylinders.

DESCRIPTION OF THE PREFERRED EMBODIMENTS

Figure 1:
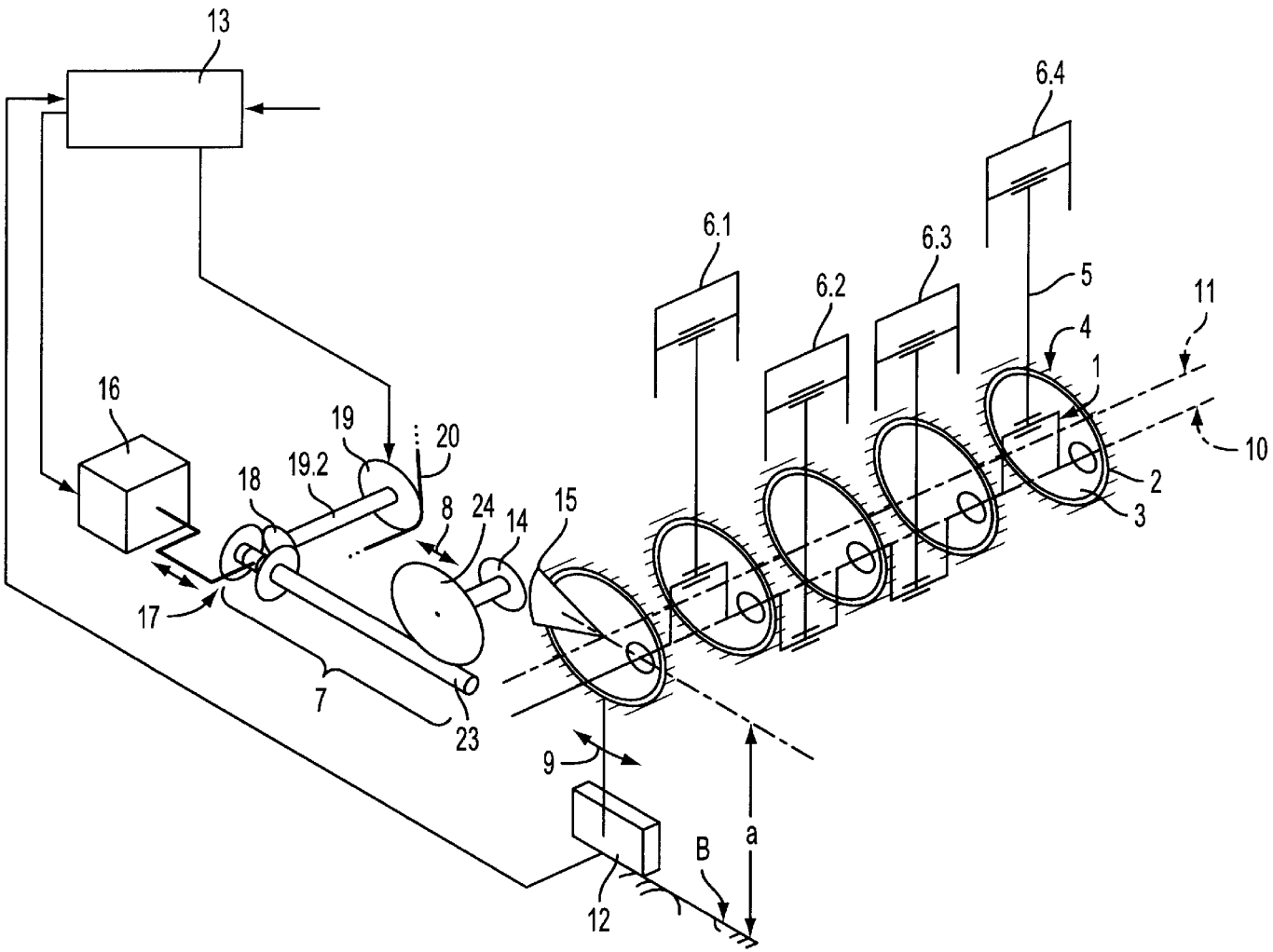
FIG. 1 is a schematic perspective view of a four-cylinder internal-combustion engine having a setting assembly according to the invention for varying the volume of the combustion chambers.

FIG. 1 shows a crankshaft 1 of a four-cylinder internal-combustion engine. The crankshaft 1 is supported in crankshaft bearings 2 held in eccentric rings 3 which, in turn, are rotatably held in a bearing support housing 4 of an engine block. Pistons 6.1, 6.2, 6.3 and 6.4 are coupled to the crankshaft 1 by respective connecting rods 5. The crankshaft 1 is shown in a position in which the pistons 6.1 and 6.4 are in their upper dead center whereas the pistons 6.2 and 6.3 are in their lower dead center.

At least one of the eccentric rings 3 is connected with a turning device constituted by a gearing 7 so that a synchronous turning of the other eccentric rings 3 may be effected by the crankshaft 1. Upon rotation of the gearing 7 in the one or other direction indicated by the double-headed arrows 8, the eccentric rings 3 are turned accordingly as indicated by the double-headed arrow 9. As a result, the height position a of the rotary axis 10 of the crankshafts 1 is changed with respect to a horizontal plane B which is a reference plane fixed relative to the engine.

As further indicated in FIG. 1, the rotary axis 10 of the crankshaft 1 is disposed eccentrically with respect to the turning axis 11 of the eccentric rings 3 and is, by means of the gearing 7, moved from an assumed mid position upwardly or downwardly on a circular path for changing the height a. As a result, the rotary axis 10 of the crankshaft 1 is raised or lowered with respect to the fixed horizontal reference plane B and also with respect to the stationary pivot axis 11 of the eccentric rings 3. This, however, means that in their upper dead center position the pistons 6.1–6.4 are closer to the combustion chamber roof of the cylinder. As a result, the compression ratio is increased, while upon a turning the eccentric rings 3 in opposite direction, the compression ratio is reduced. Also, the lateral distance of the rotary axis 10 to the cylinder axes is changed.

The gearing 7 may be connected directly with a non-illustrated shaft stub which is attached to the eccentric ring 3 to be rotated and which is coaxial with the pivot axis 11. For space saving purposes it is expedient if the gearing 7 rotates, by means of a pinion 14, a tooth segment 15 connected with the eccentric ring 3 to be turned. Different embodiments of the gearing 7 will be further described in connection with FIGS. 3 and 4.

An actuator 16 which is associated with the gearing 7 is preferably electromagnetically operated via a control unit 13. The actuator 16, in turn, operates a reversing gear unit 17 which is incorporated in the gearing 7 for changing the rotary direction of the output member of the gearing 7. The angular displacement or the change of the height position a may be detected by a sensor 12 coupled to the control unit 13. The reversing gear unit 17 is connected with a drive pinion 18 which is driven by the crankshaft 1 via a shaft 19.2, a switchable clutch 19 (such as an electromagnetic clutch operating without mechanical contacting) and a drive chain (or V-belt) 20.

Figure 2:
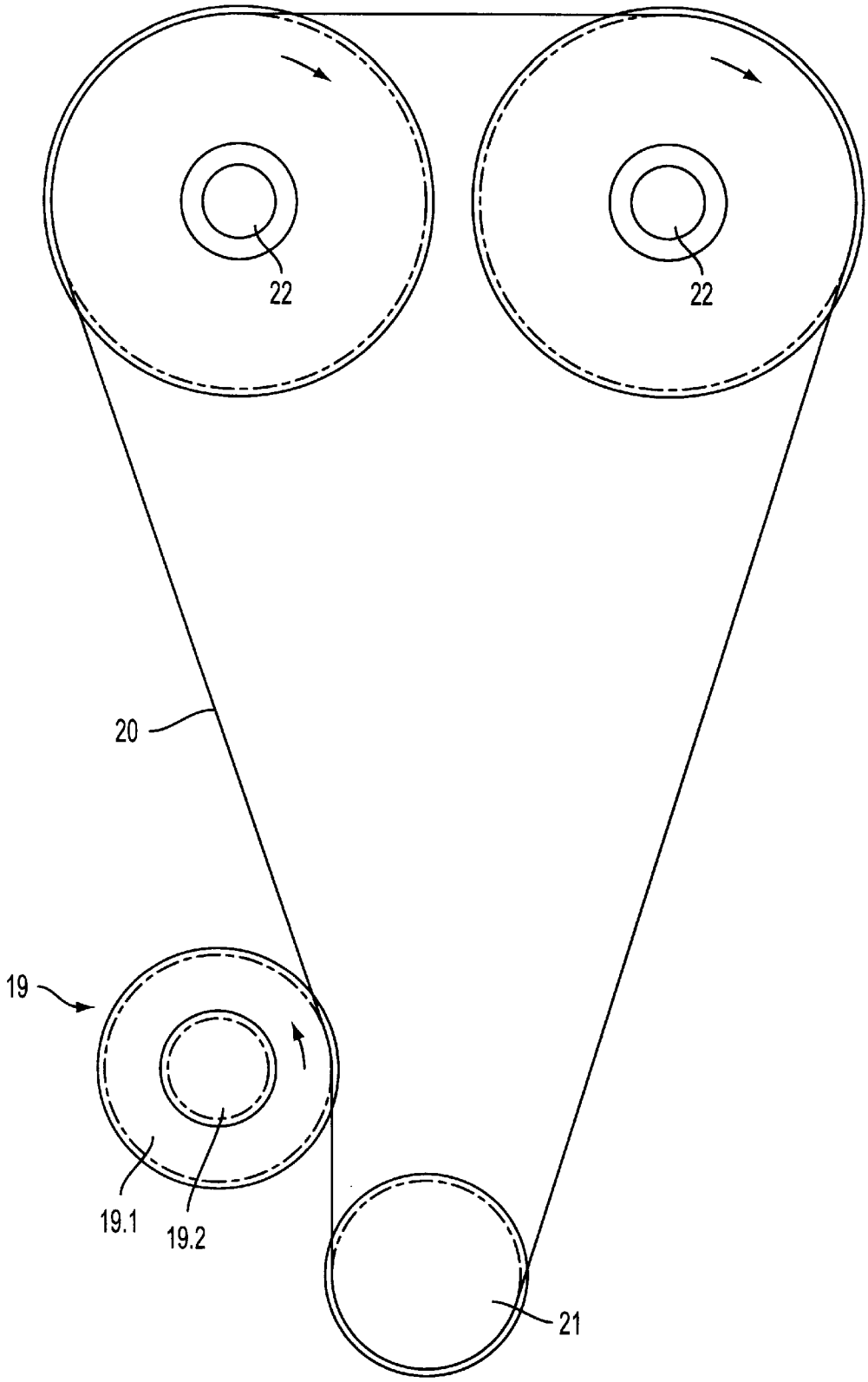
FIG. 2 is a schematic front elevational view of the driving device forming part of the invention.
Figure 5:
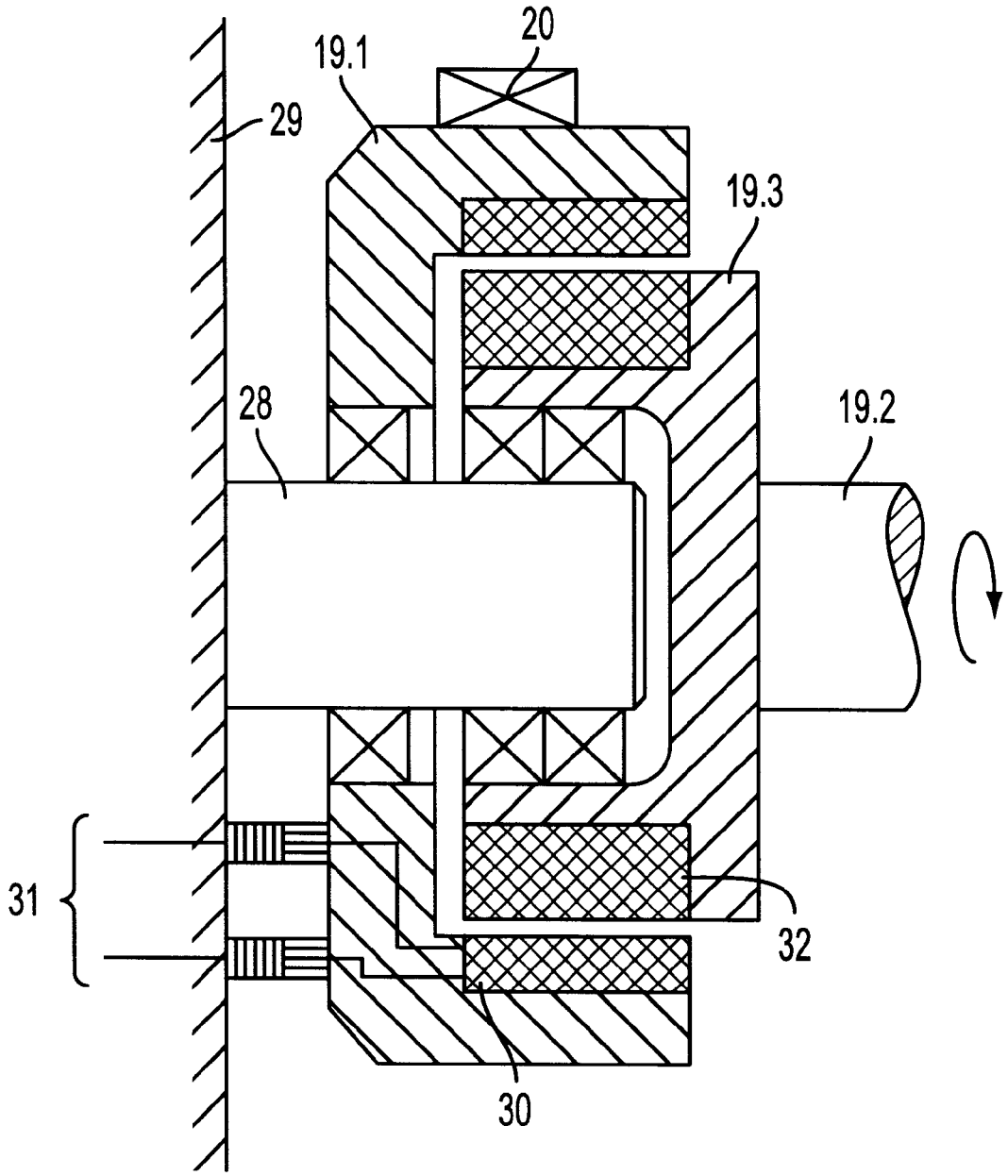
FIG. 5 is an axial sectional view of an electromagnetic clutch forming part of the invention.

As shown in FIG. 2, a drive pinion 21 of the crankshaft 1 drives the camshafts 22 via the drive chain 20 which is continuously coupled to the driving part 19.1 of the switchable electromagnetic clutch 19 to be described in further detail in conjunction with FIG. 5. The electromagnetic clutch 19 is set by generating an electromagnetic force which entrains the driven part 19.3 into rotation in the constant direction of rotation of the driving par,: 19.1. The driven part 19.3 is keyed to the shaft 19.2 with which the driving pinion 18 is connected. As controlled by the actuator 16, with a suitable switching of the reversing gear unit 17 the direction of rotation of the output member of the gearing 7 may be changed, while the clutch 19 has a constant direction of rotation. Thus, the desired back-and-forth motion of the ring gear 3 results, as indicated by the arrow 9.

Figure 3:
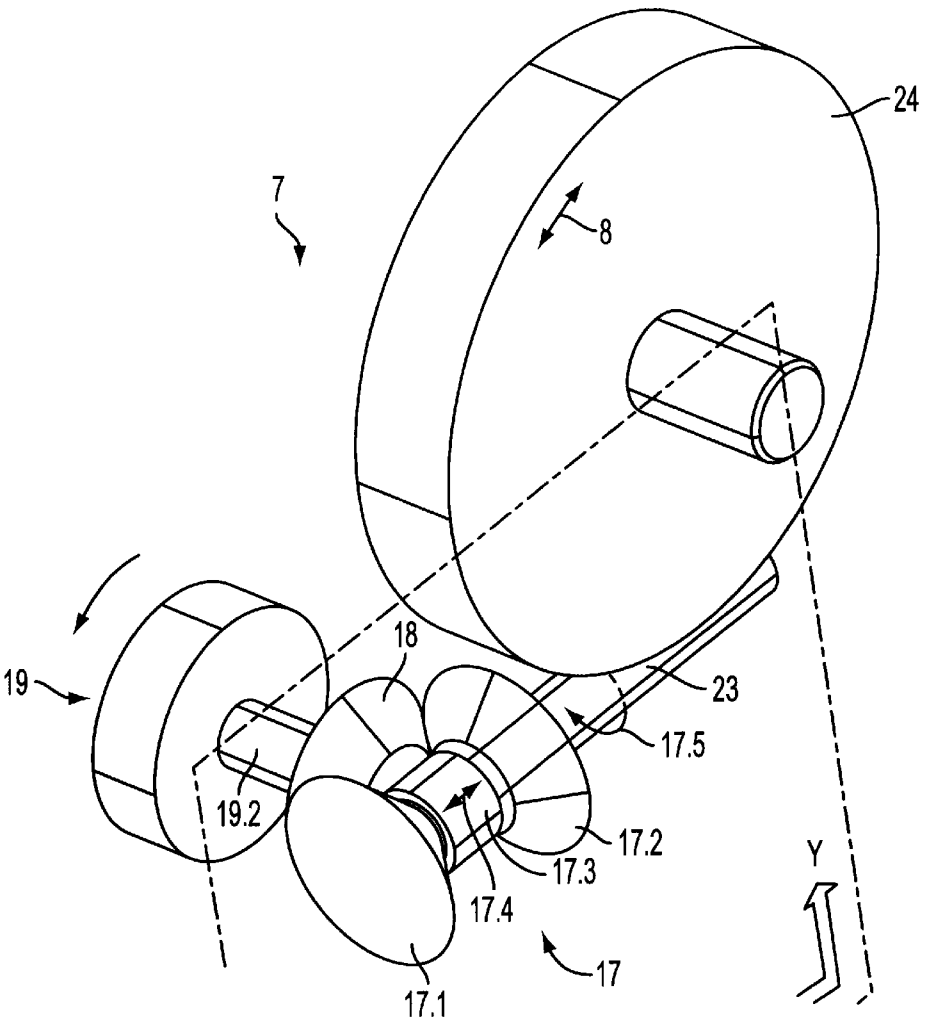
FIG. 3 is a perspective view of a setting drive including a worm-and-gear unit.

FIG. 3 illustrates a preferred embodiment of the gearing 7. The drive pinion 18 (that is, the input member of the gearing 7) keyed to the shaft 19.2 is a bevel gear which is continuously meshing with two further bevel gears 17.1 and 17.2 which thus continuously rotate in opposite directions and which form part of the reversing gear unit 17. The bevel gears 17.1 and 17.2 are axially immovably, but freely rotatably mounted on a shaft stub of a drive worm 23. The latter meshes with a gear 24 (that is, the output member of the gearing 7) which, as illustrated in FIG. 1, operates the eccentric ring 3. Between the two bevel gears 17.1 and 17.2 a switching sleeve 17.3 is torque-transmittingly and axially slidably mounted on the shaft stub of the drive worm 23. Thus, the switching sleeve 17.3 may be selectively brought into a meshing relationship by means of the actuator 16 with either the bevel gear 17.1 or the bevel gear 17.2 as the switching sleeve is axially shifted between the gears 17.1 and 17.2 in the direction of the double-headed arrow 17.4. As a result, the worm 23 is rotated either into the one or the other direction as indicated by the double-headed arrow 14.5, turning the gear 24 in the one or the other direction shown by the double-headed arrow 8. This arrangement, by virtue of the worm-and-gear unit 23, 24, results in a substantially down-stepped transmission ratio and also in a self-locking of the gearing 7.

Figure 4:
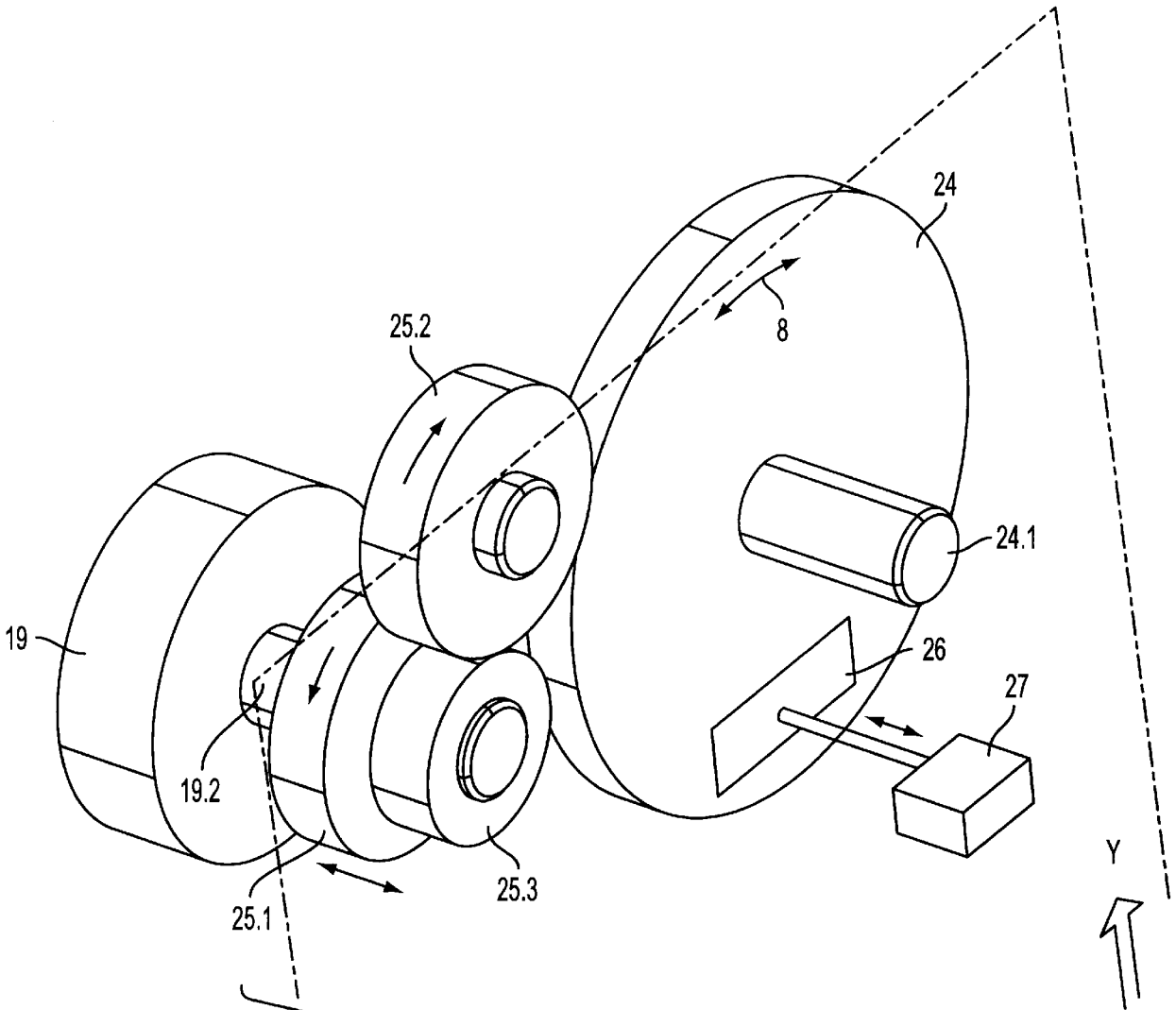
FIG. 4 is a perspective view of a variant for a setting drive.

FIG. 4 illustrates another embodiment of the drive gearing 7 composed of spur gears. The clutch 19 is connected with a reversing gear unit 25 which has a first reversing gear 25.1 and a second reversing gear 25.2. The second reversing gear 25.2 meshes with an intermediate gear 25.3 fixedly attached to the first reversing gear 25.1. Consequently, the gears 25.1 and 15.2 are continuously rotated in opposite directions by the drive shaft 19.2 of the clutch 19. The gears 25.1 and 25.2 are axially shiftable as a unit on the shaft 19.2 of the clutch 19 by a non-illustrated carrier, so that the reversing gear 25.1 or 25.2 may be brought selectively into a meshing relationship with the gear 24. As a result, the gear 24 may be selectively rotated in to the on e or other direction as indicated by the arrow 8. A desired substantial down-stepping may be achieved by a small gear keyed to the shaft 24.1 and a large gear which meshes with the small gear and which exerts a torque on the eccentric ring 3 via the pinion 14 (FIG. 1). At a given assumed down-stepping ratio of, for example, 1:40 such a gearing is essentially self-locking.

During operation of an internal-combustion engine the entire system is exposed to the usual vibrations and jars and, in addition, forces acting via the eccentric ring become effective as resetting forces during the expansion stroke, the compression stroke and the exhaust stroke. For these reasons it is expedient to provide the gear 24 with a schematically illustrated immobilizing brake 26 which is released by a suitable controllable actuator 27 during the switching of the clutch 19 and is again applied upon completion of the setting process.

FIG. 5 illustrates an embodiment of the electromagnetic clutch 19 which includes an external rotor 19.1 supported on a shaft 28 at the housing 29 of the internal-combustion engine. The external rotor 19.1 is provided with a coil 30 to which current is supplied via slip rings 31. An inner rotor 19.3 of the clutch 19, freely rotatably supported on the shaft 28, is provided, for example, with permanent magnets 32 interacting with the electromotive forces generated by the coil 30. The inner rotor 19.3 is connected by the drive shaft 19.2 with the drive pinion 18 (FIG. 1) or the drive gear 25.1 (FIG. 4). The outer drive rotor 19.1 is, as shown in FIG. 2, coupled to the drive chain 20. Instead of permanent magnets 32, the inner rotor 19.3 too, may be provided with an energizable coil supplied by current via slip rings or a contactless energy coupler for producing a magnetic field.

For setting the clutch 19, the coil 30 is energized, whereupon a magnetic field is generated which rotates with the outer rotor 19.1 and thus forces the inner rotor 19.3 into rotation. The intensity of the current supplied to the coil 30 determines the strength of the electromagnetic field and thus the torque acting on the inner rotor 19.3 and the slippage between the inner and outer rotors 19.1 and 19.3. Thus, by means of a suitable energization of the coil 30 a "soft" and slow adjustment of the setting drive may be effected.

The intensity of the energizing current for the coil 30 may be predetermined, for example, by the engine control unit in such a manner that by adapting the current to the momentary engine rpm, the current intensity for the coil 30 is such that thus despite the changing rpm's, a constant setting speed may be achieved over the entire operational range of the internal-combustion engine.

The setting drive according to the invention may be actuated not only by the internal-combustion engine itself with an interconnected electromagnetic clutch as drive means as described above. It is also feasible to use, as a drive means, a stepping motor which may change directions, a low-power electric motor or a hydraulic motor. Dependent on the configuration of the drive means including, if needed, an immobilizing brake, the setting drive may be shifted between two predetermined end positions. Or, by using a suitable sensor assembly, intermediate positions between the predetermined end positions could be set as well.

It will be understood that the above description of the present invention is susceptible to various modifications, changes and adaptations, and the same are intended to be comprehended within the meaning and range of equivalents of the appended claims.

What is claimed is:

1. A setting assembly in a piston-type internal-combustion engine comprising (a) a setting device connected to a component for adjusting a position of said component;

(b) a power device; and (c) a gearing having (1) an input member connected to said power device for driving said gearing by said power device;

(2) an output member having a direction of motion and being connected to said setting device for driving said setting device by said gearing;

(3) down-stepping means for providing a substantially down-stepped transmission ratio between said input and output members; and (4) reversing means for reversing said direction of motion of said output member.

2. The setting assembly as defined in claim 1, further comprising switchable locking means for selectively immobilizing and releasing said gearing.

3. The setting assembly as defined in claim 1, wherein said gearing is self-locking.

4. The setting assembly as defined in claim 1, wherein said gearing includes a unit composed of a worm and a gear meshing with said worm and being driven by said worm; said down-stepping means being comprised in said unit.

5. The setting assembly as defined in claim 1, wherein said reversing means comprises a switchable reversing gear unit coupling said input member with said output member; said reversing gear unit having a part movable into first and second positions for moving said output member in opposite first and second directions, respectively.

6. The setting assembly as defined in claim 1, further comprising (a) an engine-driven component of said internal-combustion engine; said internal-combustion engine and said engine-driven component constituting said power device; and (b) a settable and releasable clutch having an input part connected to said engine-driven component and an output part connected to said input member of said gearing.

7. The setting assembly as defined in claim 6, wherein said clutch is an electromagnetic clutch.

8. The setting assembly as defined in claim 1, wherein said internal-combustion engine comprises engine cylinders each having a combustion chamber; pistons movable back and forth in respective said engine cylinders; and a crankshaft connected to said pistons; said crankshaft having a crankshaft axis; said component being coupled to said crankshaft for shifting said crankshaft selectively toward or away from said engine cylinders to vary a volume of said combustion chambers.

* * * * *